United States Patent [19]

Adams

[11] 3,994,121

[45] Nov. 30, 1976

[54] POLYHEXAMETHYLENE ADIPAMIDE YARN

[75] Inventor: Earl Blaine Adams, Hixson, Tex.

[73] Assignee: E. I. DuPont de Nemours and Company, Wilmington, Del.

[22] Filed: Feb. 7, 1975

[21] Appl. No.: 547,963

Related U.S. Application Data

[63] Continuation-in-part of Ser. No. 457,402, April 3, 1974, abandoned.

[52] U.S. Cl. ..... 57/140 R; 57/157 R; 57/157 TS; 260/78 S; 264/210 F

[51] Int. Cl.[2] ..... D01D 11/00; D02G 3/02

[58] Field of Search..... 57/157 R, 140 R, 157 S, 57/157 TS, 140 J; 264/210 F, 210 R, 145; 260/75 R, 78 R, 78 S; 28/76 R

[56] References Cited

UNITED STATES PATENTS

| | | | |
|---|---|---|---|
| 2,887,155 | 5/1959 | Keefe, Jr. | 264/145 X |
| 3,346,684 | 10/1967 | Gosden | 264/210 F X |
| 3,481,558 | 12/1969 | Davies | 28/76 R X |
| 3,837,156 | 9/1974 | Langanke et al. | 57/157 TS |

FOREIGN PATENTS OR APPLICATIONS

| | | |
|---|---|---|
| 2,245,468 | 4/1973 | Germany |

*Primary Examiner*—John Petrakes

[57] ABSTRACT

Polyhexamethylene adipamide feed yarn for false-twist texturing by combined draw-texturing processes is prepared by high-speed spinning under controlled conditions to have improved stability, low shrinkage, good tenacity and uniformity. The feed yarn has break elongation and birefringence values particularly suitable for draw-texturing.

6 Claims, 4 Drawing Figures

ITEM 11 ITEM 12

POLYHEXAMETHYLENE ADIPAMIDE YARN

REFERENCE TO RELATED APPLICATION

This is a continuation-in-part of my copending application Ser. No. 457,402, filed Apr. 3, 1974, now abandoned.

BACKGROUND OF THE INVENTION

This invention relates to novel nylon yarn and a process for preparing it, and is more particularly concerned with an improved feed yarn for use in draw-texturing processes for producing false-twist textured yarns composed of polyhexamethylene adipamide (6,6-nylon).

In the conventional process for preparing nylon yarn, molten polymer is extruded through spinneret orifices into a quench chimney to form filaments which are cooled to a non-tacky state by a cross-flow of air and are withdrawn from the chimney through a steam-conditioner tube at speeds of up to about 1300 yards per minute. The filaments are then drawn to about 3 to 4 times their length (3X to 4X draw ratio) to orient the polymer molecules. Usually the draw ratio is adjusted to provide a break elongation of about 25 percent to 35 percent for textile uses.

The conventional process for preparing false-twist textured nylon yarn involves twisting the yarn, heat-setting the twist in the yarn at heater temperatures above 180° C., and then untwisting the yarn. A false-twist spindle is commonly used to twist and untwist the yarn. Recently, it has been found desirable to combine drawing with the texturing operation. This can be accomplished by reducing the draw ratio used in the above-mentioned process for preparing the feed yarn. However, such incompletely drawn feed yarns have been found to be unstable in storage, non-uniform in denier and orientation, and to have high boil-off shrinkage. Difficulties encountered in draw-texturing such yarns have included excessive filament breaks and inferior textured yarn properties.

SUMMARY OF THE INVENTION

In accordance with the present invention, it has been found that polyhexamethylene adipamide yarns can be spun at high speeds under properly controlled conditions to have adequate stability in storage, low boil-off shrinkage and good denier uniformity. The novel feed yarns of this invention also provide ease of texturing (fewer breaks) and improved textured yarn properties relative to textured yarns prepared from the above-mentioned incompletely drawn feed yarns. Other advantages of the invention will become apparent from subsequent disclosure and the claims.

The polyhexamethylene adipamide yarn of this invention is characterized by a break elongation of 50 to 115 percent (preferably 70 to 100 percent), a tenacity of at least 2.5 grams per denier, a birefringence value of at least 0.040, a boil-off shrinkage of 2 to 6 percent, and a thermal shrinkage value for $Ts_{140}$–$Ts_{90}$ which is at least +0.1 in percentage units. The birefringence value is usually from 0.040 to 0.050. The examples illustrate highly uniform yarns characterized by denier variation values within the range of 0.5 to 2.0.

The invention includes yarns of any of the conventional filament counts wherein the yarn filaments are of 1.4 to 25 denier per filament. The yarn filaments may be interlaced to assist in good package formation and subsequent yarn treatments. A light interlacing is generally preferred, e.g., an average interlace pin count of less than 150 cm. for yarns of four or more filaments.

The yarns can be prepared by melt-spinning polyhexamethylene adipamide at unusually high speed to form filaments, cooling the filaments to a non-tacky state and immediately steaming the filaments to stabilize spin orientation in the filaments, and withdrawing the filaments from the preceding operations at a speed such that R (the instantaneous rate of change of birefringence with spinning speed) is less than $5 \times 10^{-6}$ minutes per yard. The polymer, rate of cooling the filaments, the steaming conditions and the value of R are selected to provide a product having a break elongation of 50 to 115 percent, a tenacity of at least about 2.5 grams per denier, a birefringence value of at least 0.040, a boil-off shrinkage of 2 to 6 percent, and a value for $Ts_{140}$–$Ts_{90}$ of at least +0.1 percentage units. Preferred conditions are illustrated in the examples. Methods for determining the indicated values are given at the end of the specification.

DETAILED DESCRIPTION AND EXAMPLES

Figure 1:
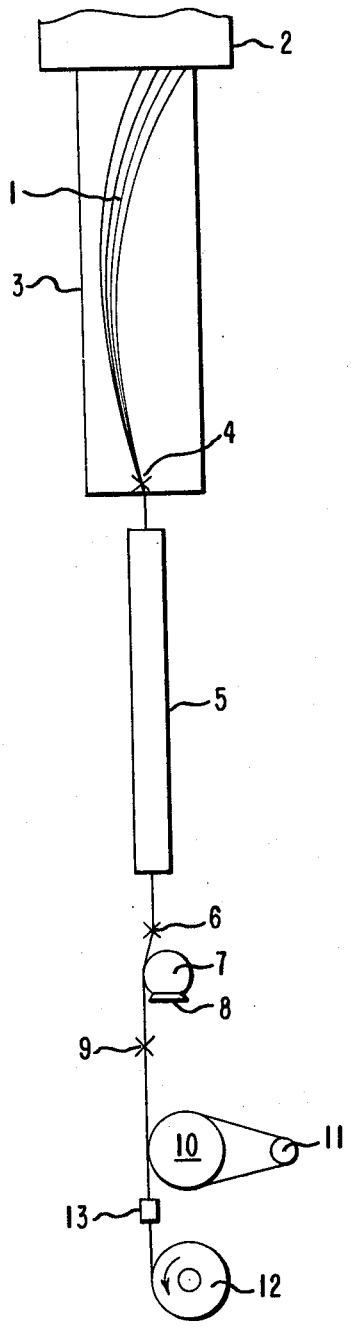
FIG. 1 is a diagrammatic representation of a preferred process for making a yarn of this invention.

A preferred process for making a yarn of this invention is illustrated in FIG. 1. Filaments 1 are extruded from spinneret assembly 2 into quench chimney 3 and are cross-flow quenched by room-temperature air flowing from right to left. Another cooling to a non-tacky state, the filaments are converged into a yarn by guide 4 and pass through steam-conditioner tube 5, through guide 6, over finish roller 7 immersed in finish bath 8, through guide 9, then wrap around high-speed puller roll 10 and associated roller 11, and are wound up as package 12. An interlace jet 13 (optional) may be used between the puller roll and the windup to interlace the yarn.

Because the filaments are extruded at unusually high speed, the length of the quench chimney should be longer than usual; a 60-inch length can be used for low filament deniers. In general, the yarn temperature should be less than 65° C. before it contacts the first guide (yarn temperature may be measured by a Fibertemp manufactured by Trans-Met Engineering, Inc., La Habra, California, U.S.A., but other methods can be used).

Steaming is important to develop the desired feed yarn properties. A 51-inch steam tube equipped with steam orifices at the top can be used with suitable steam pressures. Example I illustrates the use of 7 psig. steam. Under different spinning conditions, when spinning 26 denier, 4 filament, feed yarn at 3415 yards per minute, a steam pressure of 12 psig. is found necessary to reach the required birefringence range and also provides better denier uniformity, better spinning performance and better package acceptability. Steaming has been used in conventional low speed spinning of 6,6-nylon to lessen the tendency of filaments to grow on packages, but the importance of steaming in the present high-speed spinning process is unexpected because the product is more highly oriented.

The speed of the puller roll is sufficient to produce the desired properties in the yarn. Speeds greater than 2000 ypm (about 1830 m./min.) are preferred.

Instead of puller rolls, a pneumatic jet or other means can be used to forward the yarn.

For good package formation, the yarn may be stretched slightly, say 1.05X, between puller roll and package.

The yarn polyamide may contain minor amounts of the usual delustrants, particulate matter, antistats, optical brighteners, antioxidants and copolyamide components provided it meets the requirements set forth herein.

The yarn may be interlaced as disclosed in Bunting et al. U.S. Pat. No. 2,985,995.

Broken filaments in texturing may be reduced by proper selection of finish. Preferred finish compositions contain alkylene oxide polymers. The following are particularly good finishes, especially for multifil yarns (all percentages and parts are by weight):

A. An emulsion of:
85% water and
15% of a mixture comprising
55.17 parts of ditridecyl adipate,
38.67 parts of Atlas G-1144[1],
5.56 parts of Igepal CO-530[2], and
0.6 part of Ucon 75H-9150[3].

B. An emulsion of:
85% water and
15% of a mixture comprising 98% Pluronic L-64[4],
1% Aerosol OT[5],
0.5% triethanolamine,
0.5% oleic acid.

C. An emulsion of:
85% water and
15% of a LE-461 silicone[6].

D. An emulsion of:
85% water,
15% of a composition:
95 parts of the oil-base composition:
28.6 parts coconut oil,
40.8 parts sulfated peanut oil (dry basis),
21.8 parts oleic acid,
5.4 parts triethanolamine,
3.4 parts KOH (dry basis),
5 parts of Ucon 75H 90,000[7].

E. The same as D, but with 99 (instead of 95) parts of the oil-base composition, and only one part Ucon 75H 90,000[7].

F. The same as E, but containing no Ucon 75H 90,000.

G. An emulsion of 95 parts water and 5 parts of the composition shown in Example III of U.S. Pat. No. 3,428,560 with the exception that the sorbitol ester is produced as specified in U.S. Pat. No. 3,397,081, (col. 2, lines 59–67), using one mole of sorbitol to 30 moles of ethylene oxide and 4 or 5 moles of a mixture of oleic and lauric acids (4:1 mole ratio) to make the tetraester or pentaester. Enough KOH (45% solution) is added to make the pH of the finish emulsion about 9.

Footnotes

1. A product of ICI America, Inc. It is prepared by reacting one mole of sorbitol with about 30 mole of ethylene oxide and esterifying the product with about 5 moles of a 4:1 mixture of oleic and lauric acids.

2. A product of General Aniline and Film Corp. It is the product of about 5 to 6 moles of ethylene oxide with one mole of nonylphenol.

3. A product of Union Carbide Chemicals Co. It is poly(oxyethyleneoxy-1,2-propylene) glycol — a mixture of high molecular weight (about 14,800 number average) and low molecular weight (about 2400 number average) material. The weight ratio of ethylene oxide to propylene oxide groups is about 3:1. Preparation is described in U.S. Pat. No. 2,425,845.

4. A product of Wyandotte Chemicals Corp. It is a block copolymer of ethylene oxide and 1,2-propylene oxide of the formula:

$$HO(C_2H_4O)_m(C_3H_6O)_n(C_2H_4O)_pH$$

(where $m$, $n$ and $p$ are integers), having a number average molecular weight of about 2900 and containing about 40% of oxyethylene groups and 60% of oxy-1,2-propylene groups.

5. Sodium di(2-ethylhexyl) sulfosuccinate. It is a product of American Cyanamid and Chemical Corp.

6. A 35% aqueous emulsion of 100-centistoke dimethyl polysiloxane. It is a product of Union Carbide.

7. A product of Union Carbide. It is a poly(oxyethylene-oxy-1,2-propylene) glycol having a high molecular weight (about 14,800 number average); the weight ratio of ethylene oxide to propylene oxide groups is about 3:1. Preparation is described in U.S. Pat. No. 2,425,845.

Figure 2:
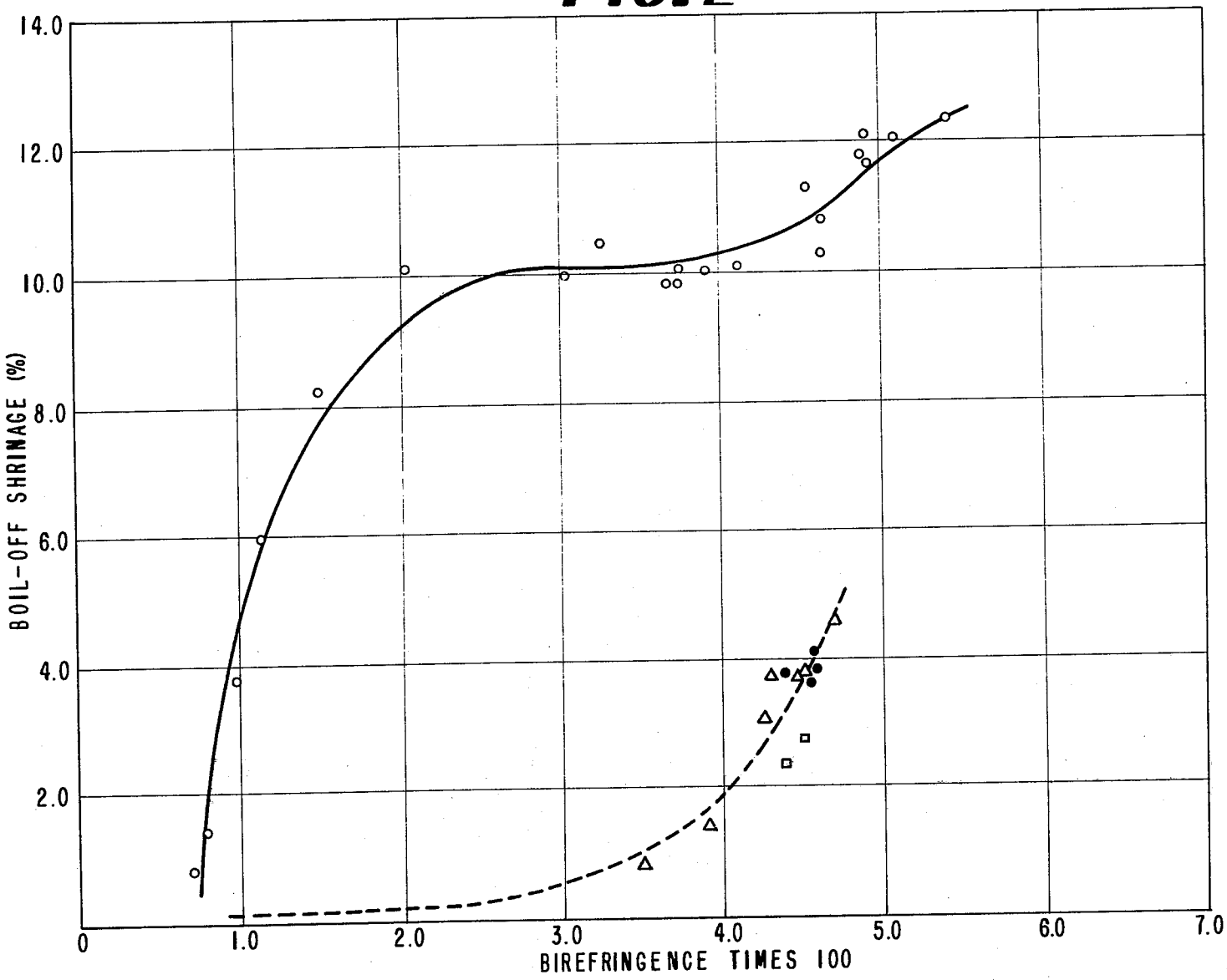
FIG. 2 is a graphical representation of boil-off shrinkage as a function of birefringence for yarns spun at high speed without cold-drawing (lower curve) in comparison with yarns spun at low speed and then partially cold-drawn (upper curve).

FIG. 2 is a plot of boil-off shrinkage as a function of birefringence for yarns spun at various speeds in the process illustrated in Example II (lower curve) in comparison with yarns spun at low speed and then cold-drawn at various draw ratios (1.05X to 5.25X) to produce various birefringence values as indicated by the circles on the upper curve. Three different yarn counts are shown on the lower curve. The dots are for 25 denier, 3 filament, feed yarns of this invention. The squares are for 26 denier, 4 filament, feed yarns of this invention. The triangles are for 29 denier, 7 filament, feed yarns; five of these have birefringence values greater than 0.040 and are yarns of this invention. The graph shows a surprising improvement in boil-off shrinkage for the new yarns in comparison with the cold-drawn yarns of the upper curve. This is advantageous in that less shrinkage occurs in fabrics made from the new yarns.

Figure 3:
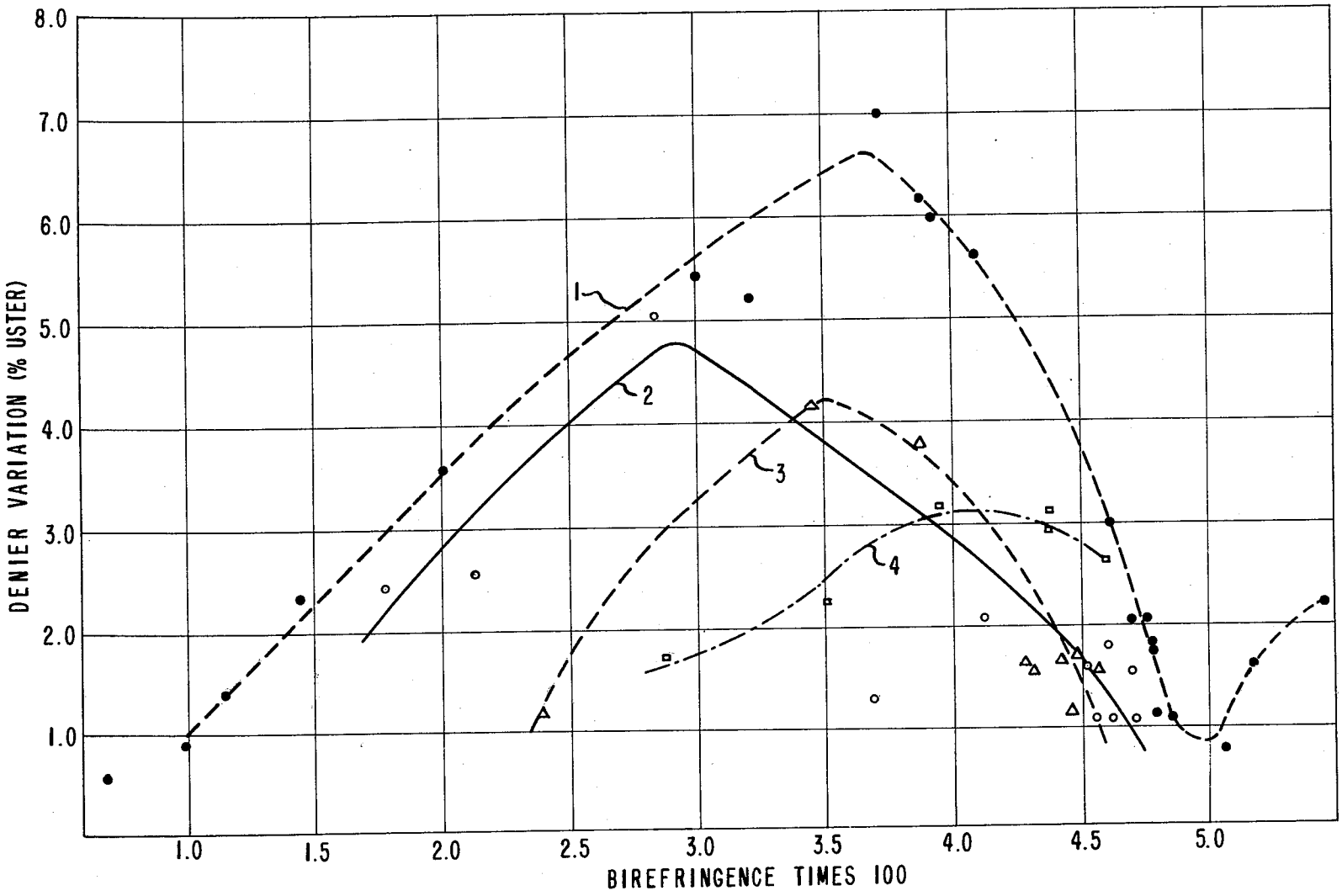
FIG. 3 is a graphical representation of denier variation as a function of birefringence for yarns spun at high speed without cold-drawing (lower three curves) in comparison with yarns spun at low speed and then partially cold-drawn (upper curve).

FIG. 3 is a plot of denier variation (% Uster) as a function of birefringence for yarns prepared as disclosed in Example II. Four curves are shown. Curve 1 is for yarn spun at low speed and then cold-drawn at various draw ratios to values indicated by the solid dots. Curves 2, 3 and 4 are for yarns spun at various speeds to have the indicated birefringence values without cold-drawing. Values for 25 denier, 3 filament (18-3 after draw texturing), feed yarns are indicated by circles adjacent to Curve 2. Values for 29 denier, 7 filament (20-7 after draw texturing), feed yarns are indicated by triangles adjacent to Curve 3. Values for 26 denier, 4 filament (18-4 after draw texturing), feed yarns are indicated by squares adjacent to Curve 4. In each case, the denier variation (% Uster) of these yarns becomes progressively worse as the birefringence increases to values of about 0.030 – 0.035, but further increase in birefringence provides a surprising improvement in denier uniformity. The yarns become quite uniform at about 0.045 birefringence. The cold-drawn yarn of Curve 1 must be drawn at a draw ratio of over 3X to reach this birefringence value, as indicated in Example IV. Textured products from it were inferior (lower tenacity and higher shrinkage) to corresponding textured yarns from the feed yarns of this invention.

EXAMPLE I

This example shows production of high-speed spun yarns suitable for false-twist texturing.

A 34RV nylon flake containing 0.3% $TiO_2$ is melted at 288° C. in a non-vented screw melter. The melt passes at 30.5 grams per minute through a standard pack and through 34 0.009-inch (0.0229 cm.) diameter, 0.012-inch (0.0305 cm.) deep spinneret capillaries. The extruded filaments pass through a 60-inch (1.52 meter) chamber where they are cross-flow quenched with room temperature air. They then contact a cross-pin guide which converges them to form a yarn. Finish is applied as the yarn passes across the rotating roll in a finish bath.

The yarn then passes through another cross-pin convergence guide and then through a 51-inch (129.5 cm.) steam conditioner tube into which 7 psig. (0.49 kg./cm.$^2$) steam is introduced from two 0.060-inch (0.152) orifices.

Without steam, yarn windup is impossible. The yarn then wraps twice around a set of puller rolls rotating at high speed and is packaged at about 0.1 to 0.2 grams per denier.

before windup. The finish is Finish F, but in 10% emulsion (instead of 15%). The yarn is stretched slightly between puller roll and package. The yarn is packaged at 0.1 to 0.3 gram per denier tension. RV of the yarn is 40–42. Ten yarns are made which differ in properties, as shown in Table I. Yarns labeled 7 through 10 are acceptable in quality, as shown by low denier variation and package acceptability. Yarns 1 through 6 are unacceptable, having either high denier variation and/or unacceptable package formation. Yarns 7 through 10, spun under conditions giving R values below $5 \times 10^{-6}$ min./yd., are highly suitable for draw-texturing to produce excellent hosiery yarn.

For comparison, 6,6-nylon undrawn feed yarn, identified As-Spun Control, produced at conventional spinning speed (shown in Table I) and designed to be fully drawn on a draw-twister is listed.

This yarn is produced essentially the same way with the exceptions listed in Table I and: spinneret orifice diameter/depth = 0.020 inch (0.051 cm.)/0.167 inch (0.424 cm); no steam is used; the finish is an emulsion of 92 parts water and 8 parts of the composition: 70 parts butyl stearate, 15 parts of the reaction product of oleyl alcohol and ethylene oxide (1:10 mole ratio), 10 parts oleic acid, 5 parts triethanolamine, 0.1 part 2,2′ thiobis(4-methyl-6-tert-butyl phenol), and 0.1 part 2,2′thiobis (4,6 dichlorophenol). This yarn is not stable upon ageing; operability at normal draw ratio deteriorates and aged yarn has poor uniformity. Another comparison yarn is made, similar to this one with the exceptions that this is a 4-filament yarn and other exception noted in Table I. This yarn after spinning and windup is cold drawn 3.822X in normal fashion in a separate step. For this yarn, yarn properties shown in Table I are for the cold-drawn yarn.

Items 1 to 10, the As-Spun Control, and the drawn

Yarn Properties are:

| Item | Speed, ypm | Denier | Tenacity | Uster | Bire-fringence | Elongation at Break |
|---|---|---|---|---|---|---|
| Control | 1250 | 260.5 | 1.36 | 3.4 | .0219 | 233.0% |
| Test | 2750 | 113.7 | 3.32 | 1.4 | .0457 | 99.2% |
| " | 3000 | 104.5 | 3.35 | 2.05 | .0468 | 93.5% |
| " | 3250 | 96.3 | 3.92 | .95 | .0469 | 96.3% |
| " | 3500 | 89.8 | 4.15 | .75 | .0469 | 93.5% |

The high-speed yarns have R values less than $5 \times 10^{-6}$ min./yd., low boil-off shrinkages, and possess considerably better denier uniformity than control yarns spun at low speeds. This yarn, made with a carefully selected finish, is highly suitable as a feed yarn for draw-texturing.

EXAMPLE II

This example shows the production of draw-textured hosiery yarns by a friction twisting process.

A 36.7RV nylon 6,6-flake containing 0.3% $TiO_2$ is melted at 291° C. in a screw melter. The melt passes through a standard pack and through three 0.018-inch (0.0457 cm.)-diameter, 0.12-inch (0.3048 cm.)-deep spinneret capillaries. Velocity of polymer through the capillaries (jet velocity) is shown in Table I. The extruded filaments are quenched, converged at a primary finish roll to a yarn, steamed and packaged essentially as in Example I. The finish is Finish G. The high-speed puller roll rotates at the speed indicated in Table I. A secondary finish is applied after the puller roll and control are textured on a false-twist texturing machine comprising, in sequence, feed rolls, heater, hollow-tube friction twister (such as described in U.S. Pat. No. 2,936,570) and takeup rolls. For Items 1–10 and the As-Spun Control, the drawing and texturing are simultaneous, i.e., the difference in speed between the feed and takeup rolls is such as to draw the yarns to the draw ratio indicated in Table II. For Drawn Control, the yarn is textured without additional drawing. Other texturing conditions are shown in Table II.

At these texturing conditions, the new yarn possesses better crimp (higher CI), as compared to standard drawn feed yarn (Drawn Control) and has higher tensile properties, and lower shrinkage as compared to the As-Spun Control.

EXAMPLE III

This example shows the importance of steam conditioning 6,6-nylon yarn.

Example II is repeated with the exceptions that four yarns of seven filaments each are produced with 0.015-inch (0.038 cm.)-diameter, 0.019-inch (0.048 cm.)-deep spinneret capillaries, and two yarns of 4 filaments each are produced with 0.020-inch (0.051)-diameter, 0.167-inch (0.424 cm.)-deep spinneret capillaries. Yarn properties and process details are given in Table III. Yarns identified by a + in the steaming row are steamed as in Example I; those identified by a − are not steamed.

Packages of the unsteamed yarn are unacceptable, even though the spinning speed is high, whereas packages of the steamed yarns are acceptable. The unsteamed yarn packages are so bad that they could not be set up on a draw-texturing machine by any normal manufacturing process. The data also show other differences between steamed and unsteamed yarns.

EXAMPLE IV

This example shows production of the new feed yarns and other feed yarns which are partially drawn.

Items 1–4 are made as in Example II. Items 5–7 are made by partially cold drawing on a draw machine equipped with a feed roll, a draw roll, and a 3/16 inch diameter (0.476 cm). draw pin situated between the rolls [yarn speed at pin is 700 ypm (640 m./m.)], of an as-spun yarn from indicated low spinning speed to the indicated draw ratios. Puller roll speeds are as indicated in Table IV. Stretch between the puller rolls and the windup package during spinning is about 1.05X for Items 1–4 and 1.0X for Items 5–7.

The yarns are draw-textured, as in Example II, using a heater plate temperature of 204° C. and draw ratios indicated in Table IV. The products prepared from the feed yarns which were spun at high speed have higher tenacity and crimp index values, and lower denier variation and boil-off shrinkage, than the products prepared from the feed yarns which were spun at low speed and partially drawn.

EXAMPLE V

This example shows that excellent draw-textured products can be produced at unusually high speeds from the new feed yarns.

A draw-texturing feed yarn is made essentially as in Example I from 37RV polyhexamethylene adipamide flake. Finish D is used and the puller roll rotates at 3200 ypm (2926 m./min.). Yarn properties are: RV, 44; tenacity, 3.2 gms./den.; elongation at break, 75.8%; denier, 96; birefringence, 0.04340; R, less than $5 \times 10^{-6}$ min./yd.; denier variation, 0.7%; boil-off shrinkage 4.2%.

The yarn is textured on a Spinner OY false-twist texturing machine Model No. 160 VK-VTS/A (without second heater) having bushings of 85 Shore hardness.

| | |
|---|---|
| Texturing conditions are: | |
| Twister speed, rpm | 20,500 |
| Plate Temperature, ° C. | 227 |
| Twist, tpi (t/cm.) | 78 (30.7) |
| Draw ratio | 1.28x |
| Pre-Twister Tension (gms.) | 10 |
| Post-Twister Tension (gms.) | 35 |
| Delivery Roll Speed, ypm (mpm) | 328 (300) |
| Textured yarn properties are: | |
| Denier | 79.9 |
| Tenacity | 3.5 gpd |
| Elongation | 30% |

The yarn is knit to a fabric on a Lawson Tube Knitter and scoured and dyed. The fabric is excellent. No nylon fabric has ever been made from false-twist textured yarns produced at such high texturing speeds which could compare to it in flatness, bulk, dye uniformity, and cover.

The fabric compares very well with fabrics made from commercial, fully-drawn, texturing feed yarns textured at only ⅓ the speed on spindle false-twist texturing equipment.

The example is essentially repeated, using the same texturing conditions except:

| | |
|---|---|
| Twister speed, rpm | 25,000 |
| Plate Temperature, ° C. | 220 |
| Draw Ratio | 1.36× |
| Pre-Twister Tension (gms.) | 19 |
| Post-Twister Tension (gms.) | 50 |
| Delivery Roll Speed, ypm (mpm) | 547 (500) |
| Textured yarn properties are: | |
| Denier | 73.5 |
| Tenacity | 4.1 gpd |
| "Fluflon" Shrinkage* | About 45% |
| Elongation | About 28% |

*Measured as specified in "Textured Yarn Technology" volume 1, Monsanto Company, 1961, pp. 268–271.

Again, the fabric has excellent flatness, bulk, cover and dye uniformity. Commercial nylon texturing feed yarn, fully drawn, would not even run at such high texturing speeds without breaking unless twist level was reduced to such a level that the yarn had very little bulk and was commercially unacceptable.

Thus, the new feed yarn provides for false-twist texturing at extremely high speed in the production of high-quality textile fabrics.

EXAMPLE VI

This example shows the production of nylon yarns at high speed with and without use of steam. It also shows use of an air jet to produce yarns at very high speeds.

Twelve polyhexamethylene adipamide yarns are made substantially as in Example I with the exceptions:

1. Flake RV is 30–32 (Yarn RV is about the same).
2. Quench chamber length is 60 inches (152 cm) long.
3. Steam conditioner tube is 75.5 inches (192 cm) long, and steam at 7.5 psig(5280 kg./m²) is introduced into it through two 0.055-inch (0.14 cm) and one 0.040-inch (0.10 cm) orifices but for items 9 through 12 (Table V) two 0.10-inch (0.254 cm) orifices are used instead.
4. Items 1 through 8 are pulled from the spinneret by means of an air jet and these yarns are not wound to a package but are piddled into a can; the other items are pulled from the spinneret by means of high speed puller rollers (10, in FIG. 1) as in the other examples herein.

Other exceptions can be seen from Table V which shows process data and yarn characteristics for these yarns.

All odd-numbered items (steamed) are satisfactory yarns according to this invention.

Figure 4:
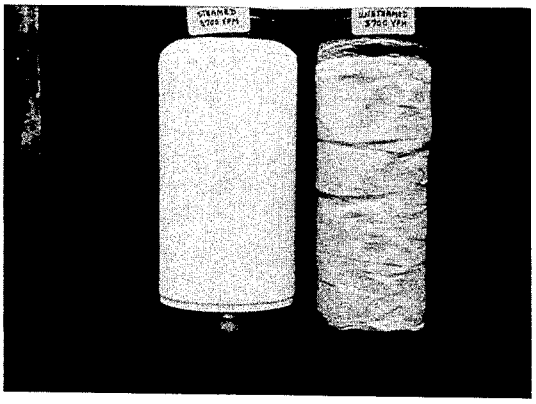
FIG. 4 is a photographic comparison of packages of steamed yarn and unsteamed yarn obtained in Example VI.

A comparison of the packages obtained with Items 11 and 12 is shown in FIG. 4. Satisfactory packages could not be wound with unsteamed Items 10 and 12.

EXAMPLE VII

This example shows production of a low-shrinkage spin-oriented 10-denier/7-filament 6,6-nylon yarn for direct use without further processing such as texturing, etc.

39-RV polyhexamethylene adipamide flake containing 0.3% $TiO_2$ is melted at 290° C. in a polymer extruder with a vacuum atmosphere. RV of the extrudate is 48–51. The melt passes through a standard pack and through seven 0.015-inch (0.0059 cm.)-diameter, 0.022-inch (0.0086 cm.)-deep spinneret capillaries. Velocity of the polymer through the capillaries (jet velocity) is 12.6 ypm (11.5 mpm). In a manner similar to that of Example I, the extruded filaments are quenched, converged to form a yarn, steamed, and finish is applied. The yarn is wound and packaged similar to Example I except the puller roll rotates at 3356 ypm (3068 m./min.), stretch between the puller roll and a letdown roll rotating at 3434 ypm (3140 m./min.) is 1.02X and windup tension is 0.7 grams/denier.

Yarn properties are: tenacity, 3.0 gms./den.; elongation at break, 52.6%; denier, 9.9; boil-off shrinkage, 4.14% birefringence, 0.04084.

The yarn is used without further processing to cover 85-dinier spandex yarn at standard commerical settings on a standard, commercial, Officine Meccaniche Menegatto covering machine. The covered yarn has excellent quality.

TABLE I

| PROCESS DATA: | 1 | 2 | 3 | 4 | 5 | 6 | 7 | 8 | 9 | 10 | As Spun Control | Drawn Control |
|---|---|---|---|---|---|---|---|---|---|---|---|---|
| Spinneret Jet Velocity (ypm) | 7.9 | 8.3 | 9.0 | 9.0 | 9.9 | 11.3 | 15.6 | 16.4 | 17.8 | 19.1 | 3.8 | 3.5 |
| Puller Roll Speed, (ypm) | 600 | 750 | 1000 | 1200 | 1449 | 1725 | 2763 | 2900 | 3188 | 3401 | 517 | 4.61 |
| Stretch Ratio Between Puller Roller and Package | 1.06× | 1.05× | 1.58× | 1.61× | 1.09× | 1.08× | 1.03× | 1.08× | 1.07× | 1.05× | 1.00× | 1.00× |
| Yarn Properties: | | | | | | | | | | | | |
| Elongation (%) | 261 | 285 | 192 | 126 | 153 | 144 | 95 | 79 | 67 | 73 | 400–700 | 30–35 |
| Tenacity (gms./den.) | 1.55 | 1.7 | 2.84 | 3.26 | 2.03 | 2.6 | | 2.36 | 3.65 | 3.58 | .2–.6 | 5.0–6.0 |
| Denier | 61.5 | 19.3 | 28.1 | 23.9 | 32.3 | 28.5 | 26.9 | 27.3 | 27.1 | 27.5 | 71.6 | 18.0 |
| Birefringence (Δn) | .0154 | .01937 | .02661 | | .03658 | .04112 | .04511 | .04606 | .04770 | .04606 | .0060 | .0550 |
| $R_t$ (× $10^6$) (min.×) | 55.0 | 42.0 | 12.0 | 8.0 | 12.0 | 6.0 | 2.0 | 1.3 | ~1.0 | ~1.0 | >5.0 | |
| Denier Variation (%) | 5.0 | 5.0 | 2.15 | 2.4 | 1.7 | 1.85 | 1.50 | 1.04 | 1.0 | 1.2 | 0.65 | |
| Package Acceptability* | – | – | – | – | – | – | + | + | + | + | – | |
| Sonic Modulus (gms./den) | 16 | 16.3 | 19.9 | 26.6 | 23.0 | 25.6 | 32.2 | 34.6 | | 34.6 | 14.6 | 61.0 |
| Differential Birefringence (δ) | | | | | | | | | | 0.029 | –0.0002 | 0.0005 |
| Low-angle X-Ray Intensity | | 11.7 | 13.8 | 9.4 | 40.9 | 33.8 | 11.4 | — | 10.3 | 11.2 | 6.5 | 6.4 |

*+means acceptable
–means unacceptable

TABLE II

| Process Data | 1 | 2 | 3 | 4 | 5 | 6 | 7 | 8 | 9 | 10 | As-Spun Control | Drawn Control |
|---|---|---|---|---|---|---|---|---|---|---|---|---|
| Draw Ratio | 3.56× | 3.09× | 2.34× | 1.78× | 2.05× | 1.69× | 1.52× | 1.43× | 1.35× | 1.31× | 3.66× | 1.00× |
| Hot Plate Temp. (° C.) | 190 | 190 | 195 | 195 | 195 | 200 | 204* | 204 | 204 | 204 | 190 | 208 |
| Tension (at entry to the twist cylinder/ at exit from the twist cylinder) (gms.) | 15.4/ 18.9 | 12.8/ 17.6 | 10.4/ 13.4 | 11.0/ 14.0 | 10.6/ 15.8 | 7.2/ 10.6 | 6.4/ 14.0 | 11.8/ 20.5 | 11.8/ 20.6 | 11.0/ 17.8 | 10.2/ 16.4 | 6.0/ 8.1 |
| Windup Speed (yds.min.) | 700 | 700 | 700 | 700 | 700 | 700 | 700 | 700 | 700 | 700 | 700 | 700 |
| Textured Yarn Properties | | | | | | | | | | | | |
| Denier | 17.4 | 16.2 | 15.1 | 14.4 | 16.1 | 16.8 | 18.7 | 20.3 | 20.4 | 21.8 | 19.7 | 19.1 |
| Tenacity (gms./den.) | 2.9 | 4.6 | 4.1 | 5.3 | 5.1 | 4.5 | 5.5 | 4.8 | 5.3 | 4.6 | 4.2 | 5.7 |
| Elongation (%) | 13.8 | 25.6 | 21.8 | 38.9 | 31.3 | 44.3 | 33.9 | 29.3 | | 28.0 | 33.0 | 36.0 |
| Modulus (gms./den.) | 26.8 | 18.5 | 25.1 | 18.2 | 22.6 | 18.9 | 18.4 | 13.6 | 24.1 | 12.5 | 16.5 | 23.1 |
| CI % | 68.5 | 69.7 | 64.2 | 65.6 | 67.6 | 68.9 | 70.5 | 71.4 | 71.4 | 74.0 | 72 | 66.8 |
| Boil-off Shrinkage % | 7.2 | 6.9 | 6.4 | 7.2 | 7.3 | 6.9 | 7.3 | 8.0 | 8.3 | 7.3 | 9.5 | 5.4 |

*Yarn Temperature - 190° C.

TABLE III

| Yarn Identification | A | B | C | D | E | F |
|---|---|---|---|---|---|---|
| No. Filaments/end | 7 | 7 | 7 | 7 | 4 | 4 |
| Spinneret Throughput (lbs./hr./end) | 1.075 | 1.075 | 1.310 | 1.310 | 1.167 | 1.167 |
| Puller Roll Speed (ypm) | .2383 | 2383 | 3241 | 3241 | 3241 | 3241 |
| Steaming[1] | + | – | + | – | + | – |
| Stretch Ratio Between Puller Roller and Package | 1.015× | 1.015× | 1.035× | 1.035× | 1.032× | 1.032× |
| Yarn Properties: | | | | | | |
| Elongation (%) | 81 | * | 96 | 86 | 72 | 70 |
| Tenacity (gms./den.) | 2.7 | * | 3.96 | 3.28 | 2.97 | 3.27 |
| Denier | 30.1 | * | 26.5 | 26.3 | 24.9 | 24.1 |
| Birefringence[2] | 0.040 | 0.037 | 0.039 | 0.036 | 0.039 | 0.036 |
| Birefringence(>2 days of aging) | – | – | .046 | .044 | +.041 | .040 |
| Package Acceptability[3] | + | – | + | – | – | – |
| Shrinkage (%) (after 3 days)[4] | | | 4.0 | 0.5 | 4.0 | 0.5 |

TABLE III-continued

| Yarn Identification | A | B | C | D | E | F |
|---|---|---|---|---|---|---|
| Differential Direfringence (δ) | | | .0052 | .0019 | | |
| Clop | | | 24.70 | 15.29 | | |
| Boil-off Shrinkage | 3.26 | | 5.04 | 1.94 | 3.15 | 1.98 |
| R(×10⁶) (min. /y) | ~4.0 | – | ~1.0 | – | ~0.7 | – |

[1]+means steam is used –means no steam is used
[2]samples measured ~2 hours after spinning
[3]same standard as in Table 1
[4]measured as in U.S. 3,748,844 at col. 6, l. 49. Sample skeins are loaded with a 3.5 mg/den. weight while shrinking
*Yarn package so badly tangled that accurate measurement could not be made.

TABLE IV

| Items | 1 | 2 | 3 | 4 | 5 | 6 | 7 |
|---|---|---|---|---|---|---|---|
| Spinning Process | | | | | | | |
| Spinneret Throughput (lb./hr./end) | 1.09 | 1.11 | 1.21 | 1.29 | 0.50 | 0.50 | 0.50 |
| Puller Roll Speed (ypm) | 2704 | 2900 | 3188 | 3401 | 517 | 517 | 517 |
| R(× 10°) (min./yd.) | ~1.0 | ~1.0 | ~1.0 | ~1.0 | ~52.0 | ~52.0 | ~52.0 |
| Draw Ratio | no cold draw | no cold draw | no cold draw | no cold draw | 2.62× | 3.00× | 3.23× |
| Steaming | + | + | + | + | – | – | – |
| Feed Yarn Properties | | | | | | | |
| Denier | 28.6 | 27.3 | 27.1 | 27.5 | 27.8 | 24.6 | 22.9 |
| Elongation (%) | 85.3 | 79.3 | 66.8 | 72.8 | 96.7 | 72.0 | 64.0 |
| Birefringence (Δn) | 0.0458 | 0.0461 | 0.0477 | 0.0461 | 0.0419 | 0.0462 | 0.0468 |
| Tenacity, (gms/den) | 3.3 | 3.4 | 3.7 | 3.6 | 3.7 | 3.7 | 4.5 |
| Boil-off shrinkage, % | ~3.7 | ~4.1 | ~4.4 | ~4.1 | 10.2 | 10.9 | 10.4 |
| Denier Variation (%) | 1.2 | 1.5 | 1.0 | 1.2 | 5.6 | 3.0 | 1.7 |
| Draw-Texturing Process | | | | | | | |
| Draw Ratio | 1.438× | 1.428× | 1.333× | 1.236× | 1.438× | 1.333× | 1.236× |
| Tension (at entry to the twist cylinder/at exit from twist cylinder (gms.) | 12.8/16.8 | 10.1/16.0 | 9.6/15.6 | 9.4/14.2 | 8.6/12.8 | 8.4/17.6 | 9.6/18.0 |
| Windup Speed, (ypm) | 700 | 700 | 700 | 700 | 700 | 700 | 700 |
| Textured Yarn Properties | | | | | | | |
| Denier | 20.3 | 19.5 | 20.2 | 23.3 | 19.6 | 19.0 | 19.0 |
| Tenacity (gms./den.) | 4.5 | 5.1 | 5.2 | 4.6 | 3.4 | 3.2 | 3.6 |
| Elongation (%) | 30.7 | 34.2 | 27.9 | 27.2 | 24.7 | 21.3 | 23.3 |
| Modulus (gms./den.) | 23.2 | 27.6 | 27.0 | 25.1 | 16.1 | 13.9 | 9.2 |
| CI, % | 74.3 | 73.2 | 73.1 | 74.7 | 72.2 | 69.0 | 69.4 |
| Boil-off Shrinkage, (%) | 5.96 | 4.9 | 5.9 | 6.4 | 8.01 | 7.08 | 7.78 |

TABLE V

| Item | 1 | 2 | 3 | 4 | 5 | 6 | 7 |
|---|---|---|---|---|---|---|---|
| Process Data | | | | | | | |
| Puller Roll Speed (ypm)[1] | 3000 | 3000 | 3700 | 3700 | 4700 | 4700 | 5500 |
| Steaming[2] | + | – | + | – | + | – | + |
| Spinneret Capillary Size (mils) diameter/length | 9/12 | 9/12 | 18/140 | 18/140 | 9/12 | 9/12 | 15/19 |
| Stretch Ratio Between Puller Roller and Package | 0 → | | | | | | |
| Yarn Properties | | | | | | | |
| Denier/No. of Filaments | 224/40 | 224/40 | 260/48 | 260/48 | 124/40 | 124/40 | 151/56 |
| Tenacity (gm./den.) | 3.20 | 2.60 | 3.20 | 2.70 | 3.26 | 2.95 | 3.37 |
| Elongation | 74% | 89.5% | 79% | 83.6% | | 63% | 57% |
| Birefringence | 0.04266 | .03905 | .04321 | .04086 | .04527 | .03968 | .04492 |
| Boil-Off Shrinkage (%) | 2.32 | 0.45 | 2.95 | 0.46 | 3.52 | 1.61 | 2.80 |
| $Ts_{140}$ - $Ts_{90}$ (%) | +0.85 | –0.25 | +0.55 | –1.15 | +0.95 | –0.75 | +0.75 |
| $Ts_{140}$ - $Ts_{90}$ (%)[3] | +0.25 | –0.35 | +0.35 | –1.15 | +0.65 | –0.45 | +0.45 |

| Item | 8 | 9 | 10 | 11 | 12 |
|---|---|---|---|---|---|
| Process Data | | | | | |
| Puller Roll Speed (ypm)[1] | 5500 | 3000 | 3000 | 3700 | 3700 |
| Steaming[2] | – | + | – | + | – |
| Spinneret Capillary Size (mils) diameter/length | 15/19 | 9/12 | 9/12 | 18/140 | 18/140 |
| Stretch Ratio Between Puller Roller and Package | 0 | <1.05× → | | | |
| Yarn Properties | | | | | |
| Denier/No. of Filaments | 151/56 | 56/10 | 54/10 | 14.5/3 | 12.0/3 |
| Tenacity (gm./den.) | 3.28 | 2.90 | 2.80 | 3.20 | 3.50 |
| Elongation | 69% | 94 | 85.9 | 74.8 | 76.8 |
| Birefringence | .04257 | .04015 | .04036 | .04025 | .04127 |
| Boil-Off Shrinkage (%) | 1.92 | 3.79 | 0.25 | 4.72 | 0.82 |
| $Ts_{140}$ - $Ts_{90}$ (%) | –0.20 | +1.55 | –0.25 | +1.05 | –1.10 |
| $Ts_{140}$ - $Ts_{90}$ (%) After aging[3] | –0.20 | +1.40 | –1.25 | +2.00 | –0.95 |

[1]For items 1 through 8 this is the speed of the yarn through the air jet
[2]+ means steam is used; – means no steam is used
[3]Samples aged 0.5–2 months prior to measurements

EXPLANATION OF TERMS

Birefringence ($\Delta n$), by definition, is the difference in refractive index for light polarized parallel to the fiber axis ($n_{\parallel}$) and light polarized perpendicular to the fiber axis ($n_{\perp}$); i.e., $\Delta n = n_{\parallel} - n_{\perp}$. Birefringence can be and is measured herein by the retardation technique described in Fibers from Synthetic Polymers, by R. Hill (Elsevier Publishing Company, New York, 1953) pages 266–268, using a polarizing microscrope with rotatable stage together with a Bereck compensator. The birefringence is calculated by dividing the measured optical retardation by the measured thickness of the fiber. The yarn is conditioned in a room at 72% relative humidity and 74° F for 48 hours before measurement.

Differential birefringence ($\delta$) is defined herein as the difference between the average birefringence near the surface of a fiber and the extreme birefringence within the fiber near its center. This definition is best understood from its method of measurement; a double-beam interference microscope, such as is manufactured by E. Leitz, Westziar, A. G., is used. The fiber to be tested is immersed in an inert liquid of refractive index $n_L$ differing from that of the fiber by an amount which produces a maximum displacement of the interference fringes of 0.2 to 0.5 wavelengths. The value of $n_L$ is determined with an Abbe refractometer calibrated for sodium D light and not corrected for the mercury green light used in the interferometer. The fiber is placed in the liquid so that only one of the double beams passes through the fiber. The fiber is oriented with its axis perpendicular to the undisplaced fringes and to the optical axis of the microscope. The patthern of interference fringes is recorded on T-410 Polaroid film at a magnification of 1000X. Fringe displacements are related to refractive indices and to fiber thicknesses, according to the equation:

$$\frac{d}{D} = \frac{(n - n_L)t}{\lambda}$$

where $n$ is the refractive index of the fiber $\lambda$ is the wavelength of the light used (0.546 microns)

$d$ is the fringe displacement $D$ is the distance between adjacent fringes $t$ is the path length of light (i.e., fiber thickness) at the point where $d$ is measured.

For each fringe displacement, $d$, measured on the film, a single $n$ and $t$ set applies. In order to solve for the two unknowns, the measurements are made in two liquids, preferably one with higher and one with lower refractive index than the fiber according to criteria given above. Thus, for every point across the width of the fiber, two sets of data are obtained from which $n$ and $t$ are then calculated.

As stated before, birefringence, ($\Delta n$) is the difference in refractive index for light polarized perpendicular to the fiber axis ($n_{\perp}$) and for light polarized parallel to the fiber axis ($n_{\parallel}$); i.e., $(\Delta n) = (n_{\parallel} - n_{\perp})$. Differential birefringence ($\delta$) is then computed as the difference between the birefringence near the fiber surface, $(\Delta n)_s$, (i.e., at a point displaced laterally from the fiber axis by at least $0.95r$, where $r$ is the fiber radius) and the extreme birefringence within the fiber core, $(\Delta n)_c$, (i.e., at a point which may be located between the fiber center and $0.65r$.).

In all of the above calculations, all linear dimensions are in the same units and are converted, where necessary, either to the magnified units of the photograph or to the absolute units of the fiber.

Optical Crystallinity, $CI_{op}$ is determined from isotropic refractive index. The quantity $\frac{1}{3}(n_{\parallel} + 2n_{\perp})$ is known as isotropic refractive index, where $n_{\parallel}$ and $n_{\perp}$ are refractive indices of the fiber with light polarized parallel and perpendicular to the fiber axis. These are measured by the method discussed above under differential birefringence. P. H. Herman's Physics and Chemistry of Cellulose Fibers, Elsevier Pub. Co., New York, Amsterdam, et al., 1949 p-231 et seq.) showed that $\frac{1}{3}(n_{\parallel} + 2n_{\perp}) \times K$ = flotation density of the fiber where $K$ is a constant. The optical crystallinity is derived by linear interpolation between $n_{iso}$ of an amorphous sample (1.52900) and $n_{iso}$ of the crystalline phase (1.54600). The equation of the linear interpolation between these values (assuming 0 and 100 $CI_{op}$) is $$CI_{op} = 5882\,(n_{iso} - 1.52900)$$

R, expressed in minutes/yard, is the instantaneous rate of change of spun birefringence ($\Delta n$) with spinning speed. It is defined by:

$$R = \frac{d(\Delta n)}{d(ss)} = \lim_{\Delta ss \to 0} \frac{\Delta(\Delta n)}{\Delta ss} \sim \left(\frac{\Delta n_2 - \Delta n_1}{ss_2 - ss_1}\right)$$

Where:

$\Delta n$ = spun birefringence $ss$ = spin speed, ypm

For a given yarn count, the R can be obtained by (a) measuring the birefringences of yarns spun at different speeds, (b) constructing birefringence versus spin speed curve, (c) calculating the instantaneous slopes of the curve segment between $ss_1$ and $ss_2$ at 100 ypm increments according to approximation expression (3) in above equation.

Relative viscosity ($RV_{66}$) of 6,6 nylon is defined as the ratio of the absolute viscosity ($\eta_{66}$) in centiposie of an 8.4% by weight solution of 6,6 nylon in 90% formic acid to the absolute viscosity ($\eta_F$) in centipoise of the 90% formic acid.

$$RV_{66} = \frac{\eta 66}{\eta F}$$

Reported values were determined by ASTM method D789-53T and the result multiplied by the constant 1.0183.

Break elongation, tenacity, and initial modulus are determined on a table model instron generally according to ASTM method D2256-66T. All samples are conditioned on the package for 24 hours at 74° F and 72% relative humidity (RH) and measured in the same environment. The properties for yarns of 10 or more filaments, e.g., the tenacity and elongation reported in Example 1, are measured with these machine and sample conditions:

5 inch per minute extension rate.

5 inch gauge length.

Pneumatic rubber coated Instron clamps.

Three turns per inch of twist added to sample.

The tensile properties and elongation for yarns of less than 10 filaments are measured with these machine and sample conditions:

6 inch per minute extension rate.

1 and one-half inch gauge length for feed yarn.

10 inch gauge length for textured yarn.

Pneumatic rubber coated Instron clamps.

Single-strand straight sample.

Sonic modulus (E) is measured on a Modulus Uniformity Monitor commerically available from the H. M. Morgan Company, Cambridge, Massachusetts. Sonic Modulus (E) is defined as:

$$E = 11.3 \times C^2$$

where C = Sonic velocity along the threadline axis in kilometers per second. Sonic velocity is defined as:

$$C = \lambda \times f$$

where $\lambda$ = Sound wavelength in meters.

$f$ = Sound frequency in kilocycles per second.

The Modulus Uniformity Monitor operates on the principal of imposing a sound wave of fixed frequency (6.75KC/sec.) along the axis of a moving threadline and measuring the soundwave length ($\lambda$) through the fiber. This $\lambda$ is a function of the modulus (E) of the yarn as described in the above equations. Reported values were measured at a yarn speed of twenty-one feet per minute and a threadline tension of four grams for feed yarns. For textured yarns tension is increased to 10 gms. (0.55 gm/denier) to remove crimp in the yarn generated by torque. For 70-denier textured yarns, a tension of 0.35 gm./denier is used.

Low angle X-ray intensity is reported as maximum optical density of a given low angle discrete diffraction streak or spot on small angle X-ray diffraction film. Measurements are made by standard flat plate photographic technique (using the Warhus camera as described in handbook of X-rays, Chapter 21, Characterization of Polymers, 1967, McGraw Hill Book Company, New York) on General Electric XRD-V twin tube equipment. Sample to film distance is 17 cm and the fiber is wrapped around a 0.040 inch sample holder. In photographing the fibers, extreme care is taken to use the same amount of fiber and to expose the sample to the X-ray beam for 14 hours. To eliminate camera alignment problems, the same camera is used for all measurements. Kodak No Screen film is used. After standard development, the film is densitometered to measure the peak intensity of the discrete small angle diffraction using a Joyce Loebl Microdensitometer with a 0.5 mm height and 0.4 mm width of slit (Model MK III).

Draw-texturing means a process in which a yarn is drawn and false-twist-textured in a single step, generally as shown in U.S. Pat. No. 3,772,872. Drawing and texturing may occur simultaneously (the yarn is drawn as it is passing over the texturing heater) or drawing may occur just prior to entry into the false-twist zone. A combination of these can be used.

Denier variation is measured on a model C Uster evenness tester manufactured by Zellweger LTD. Reported values are the average linear irregularity of the cross section of the yarn expressed percent Uster (%U). The mathematical definition of % U is given below:

$$\% U = \frac{100}{q} \cdot \frac{1}{L} \int_0^L (q - \bar{q})\, dl$$

where

L = Length of the yarn over which the values mentioned are determined (evaluating length).

$q$ = Instantaneous value of the yarn cross section.

$\bar{q}$ = Average value of the cross section of the yarn over the length L.

$dl$ = Differential of the length.

Reported %U values were measured with the following machine settings:

Speed — 100 yards per minute of yarn.

Machine sensitivity — normal test.

Evaluating time — 1 minute.

Operating tension — 5 grams between tension brake and measuring head.

Boil-off shrinkage is the change in length as a percentage of original length of a skein of yarn upon immersion in boiling water. Reported values were measured according to the following procedure:

Skeins of yarn are prepared on a standard denier reel of 1⅛ meters circumference. The number of revolutions on the denier reel is determined as follows:

7–29 denier — 800 revolutions.

30–50 — 400 revolutions.

51 denier and above — 200 revolutions.

The skeins are then straightened by hanging one end of the skein on one-half inch diameter horizontal rod and attaching a 4.68 pound weight on the other end of the skein. The weight is then raised vertically 6 inches and allowed to fall freely. Raising and dropping of the weight is repeated until a constant skein length ($L_1$) is obtained. The skeins are then wrapped in cheesecloth, 8 skeins to a bundle, and placed in a boiloff pot at 100° C for 70 minutes. This is followed by a 5-minute spin cycle in a commercial washing machine. The skeins are lagged at 74° F. and 72% RH for 24 hours. The skein length, after boil-off, $L_2$ is measured by using the same procedure as for $L_1$. Boil-off shrinkage is then calculated according to the formula, $$\% \text{ Boil-off shrinkage} = \frac{L_1 - L_2}{L_1} \times 100$$

Crimp index (CI%) is measured using this procedure: Yarn conditioning before and during measurement is done at 74° F and 72% RH. Skeins are prepared on a standard denier reel of 1⅛ meters circumference after conditioning for 2 hours. The skeins are wound to an approximate skein denier of 1666. The number of revolutions of the denier reel is determined by this formula to the nearest whole number:

$$\text{No. of Rev.} = \frac{833}{\text{Yarn Denier}}$$

After conditioning for 30 minutes, the skeins are loaded with a 2.5 gram weight and the skein length ($L_1$) is measured. The skeins are then steamed at 100° C for 2 minutes, removed from the steamer, conditioned for 30 minutes, loaded with a 2.5 gram weight, and skein length $L_2$ is measured. Next, the skeins are loaded with a 695 gram weight and the skein length $L_3$ is measured. The weights are loaded onto the skeins and the lengths are measured automatically by a Texturmat (manufactured by Herbert Stein Monchengladbach). For $L_3$ measurement, the Texturmat has been modified to load the skeins with 695 grams instead of the original 250 grams weight. For the length measurement, the machine is calibrated internally to read 188 millimeters (mm) when using a 200 mm calibration bar, and to read 1180 mm when using a 1200 mm calibration bar.

Cl% is calculated by the formula, $$Cl\% = \frac{L_3 - L_2}{L_3} \times 100$$

Thermal shrinkage (TS) is the change in length as a percentage of original length of a skein upon heating. It is measured as follows:

A skein of about 200 denier is prepared by winding a yarn specimen on two small hooks, 4 inches apart, tying the ends securely and removing the hooks. The number of revolutions ($n$) is:

$$n = \frac{200}{2 \times \text{denier of yarn}}$$

($n$ being the whole number which produces a final skein denier closest to 200.)

The skein is then hung on a hook in a small circular oven. A one gram load is applied to the bottom of the skein. Temperature of the oven is raised at a rate of 30° C./minute. Length of the skein is measured continuously and electronically, as temperature is raised.

Thermal shrinkage is calculated according to the formula:

$$Ts = \frac{L_o - L}{L_o} \times 100$$

where $L_o$ = initial skein length and L = skein length at a given temperature. Average values for four samples are used.

$Ts_{90}$ is determined for L at an oven temperature of 90° C. $Ts_{140}$ is determined for L at an oven temperature of 140° C. $Ts_{140}$–$Ts_{90}$ is the value reported herein. The distance between points of interlace along a threadline is measured on an automatic pin-drop tester similar to the one shown in Hitt, U.S. Pat. No. 3,290,932. Yarn from the sample is first stripped for 30 seconds into a sucker gun. The treadline is then passed over a tension wheel (one loop), then over three guide pins and an alignment pin to a 1¼ inch diameter drive roll and separator roll, and finally exhausted into a sucker gun. Five wraps are taken around the drive and separator rolls. Between the drive roll and the alignment pin an injector needle is inserted into the yarn bundle between filaments. The drive roll moves the yarn at a speed of 3.92 inches per minute.

At points of interlace the yarn snags on the needle and tension builds up. The machine is set to stop when tension reaches 8 grams. Distance the yarn travels between points of interlace is measured electronically. Ten readings per sample are measured and averaged.

I claim:

1. A polyhexamethylene adipamide yarn characterized by a break elongation of 50 to 115 percent, a tenacity of at least about 2.5 grams per denier, a birefringence value of at least 0.040, a boil-off shrinkage of 2 to 6 percent, and a value for $Ts_{140}$–$Ts_{90}$ of at least +0.1 in percentage units.

2. Yarn as defined in claim 1 wherein the breake elongation is 70 to 100 percent.

3. Yarn as defined in claim 1 wherein the birefringence value is 0.040 to 0.050.

4. Yarn as defined in claim 1 wherein the yarn is further characterized by having a denier variation value of 0.5 to 2.0.

5. Yarn as defined in claim 1 wherein the yarn filaments are of 1.4 to 25 denier per filament.

6. Yarn as defined in claim 1 wherein the yarn is an interlaced yarn of at least four filaments having an interlace pin count of les than 150 cm.

* * * * *

UNITED STATES PATENT OFFICE

CERTIFICATE OF CORRECTION

PATENT NO. : 3,994,121

DATED : November 30, 1976

INVENTOR(S) : Earl Blaine Adams

It is certified that error appears in the above-identified patent and that said Letters Patent are hereby corrected as shown below:

Col. 3, line 12, following "(about 1830 m./min.)" insert -- can be used, but speeds greater than 3000 ypm (about 2740 m./min.) --.

Col. 9, Table I, line 12, change "19.3" to -- 49.3 --.

Col. 9, Table I, line 13, change ".0154" to -- .01541 --.

Col. 9, Table I, line 14, change "$R_1$ (x $10^6$) (min. x)" to -- R(x $10^6$) (min./yd.) --.

Col. 9, Table III, next-to-last line, item E, change " - " to -- + --.

Col. 11, Table IV, line 6, change "R(x 10°) (min./yd.)" to -- R(x $10^6$) (min./yd.) --.

Col. 13, line 38, change "patthern" to -- pattern --.

Col. 14, line 46, change "centiposie" to -- centipoise --.

Col. 16, line 5, change "$\frac{100}{q}$" to -- $\frac{100}{\bar{q}}$ --.

UNITED STATES PATENT OFFICE

CERTIFICATE OF CORRECTION

Patent No. 3,994,121 Dated November 30, 1976

Inventor(s) Earl Blaine Adams

It is certified that error appears in the above-identified patent and that said Letters Patent are hereby corrected as shown below:

Col. 18, line 31, change "breake" to -- break --.

Signed and Sealed this

*twelfth* Day of *July 1977*

[SEAL]

*Attest:*

RUTH C. MASON
*Attesting Officer*

C. MARSHALL DANN
*Commissioner of Patents and Trademarks*